US012577691B2

(12) United States Patent
Yoshimura et al.

(10) Patent No.: US 12,577,691 B2
(45) Date of Patent: Mar. 17, 2026

(54) WATER ELECTROLYSIS CELL AND WATER ELECTROLYSIS STACK

(71) Applicant: TOYOTA JIDOSHA KABUSHIKI KAISHA, Toyota (JP)

(72) Inventors: Joji Yoshimura, Toyota (JP); Tomoyuki Kayama, Nagakute (JP); Tsuyoshi Hamaguchi, Nagakute (JP); Ryuichi Iwata, Nagakute (JP); Takahiro Ikeda, Nagakute (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 457 days.

(21) Appl. No.: 18/162,983

(22) Filed: Feb. 1, 2023

(65) Prior Publication Data

US 2023/0304173 A1 Sep. 28, 2023

(30) Foreign Application Priority Data

Mar. 28, 2022 (JP) ..... 2022-051618

(51) Int. Cl.

| | |
|---|---|
| ***C25B 9/23*** | (2021.01) |
| ***C25B 1/04*** | (2021.01) |
| ***C25B 9/77*** | (2021.01) |
| ***C25B 11/032*** | (2021.01) |
| ***C25B 13/02*** | (2006.01) |

(52) U.S. Cl.

CPC ..... *C25B 9/23* (2021.01); *C25B 1/04* (2013.01); *C25B 9/77* (2021.01); *C25B 11/032* (2021.01); *C25B 13/02* (2013.01)

(58) Field of Classification Search

None

See application file for complete search history.

(56) References Cited

U.S. PATENT DOCUMENTS

2007/0048590 A1 3/2007 Suh
2009/0325020 A1* 12/2009 Numata ..... H01M 8/2457 429/436
2011/0229792 A1 9/2011 Dadheech et al.

(Continued)

FOREIGN PATENT DOCUMENTS

DE 112005002778 T5 8/2007
DE 102011014154 A1 12/2011
DE 102020215408 A1 6/2022

(Continued)

*Primary Examiner* — Louis J Rufo

(74) *Attorney, Agent, or Firm* — Hunton Andrews Kurth LLP

(57) ABSTRACT

A water electrolysis cell includes an anode disposed on one side across a solid polymer electrolyte membrane and a cathode disposed on the other side. The anode is configured of an anode catalyst layer, an anode gas diffusion layer, and an anode separator, laminated in that order from a side of the solid polymer electrolyte membrane. The cathode is configured of a cathode catalyst layer, a cathode gas diffusion layer, and a cathode separator, laminated in that order from the side of the solid polymer electrolyte membrane. A first channel is provided in the anode separator, and a wall face of the first channel in the anode separator is imparted with water repellency. A second channel is provided in the cathode separator, and a wall face of the second channel in the cathode separator is imparted with hydrophilicity.

6 Claims, 3 Drawing Sheets

(56) References Cited

U.S. PATENT DOCUMENTS

2021/0285427 A1 9/2021 Nakaue et al.

FOREIGN PATENT DOCUMENTS

| | | | |
|---|---|---|---|
| JP | 2007066901 | A | 3/2007 |
| JP | 2010189689 | A | 9/2010 |
| JP | 2010189708 | A | 9/2010 |
| WO | 2006055146 | A2 | 5/2006 |
| WO | 2020129513 | A1 | 6/2020 |

* cited by examiner

WATER ELECTROLYSIS CELL AND WATER ELECTROLYSIS STACK

CROSS-REFERENCE TO RELATED APPLICATION

This application claims priority to Japanese Patent Application No. 2022-051618 filed on Mar. 28, 2022, incorporated herein by reference in its entirety.

BACKGROUND

1. Technical Field

The present disclosure relates to a water electrolysis cell, and a water electrolysis stack, used in water electrolysis.

2. Description of Related Art

Japanese Unexamined Patent Application Publication No. 2010-189689 (JP 2010-189689 A), for example, discloses a water electrolysis stack configured such that water electrolysis cells fastened by a plurality of screw shafts are stacked in a vertical direction, with anodes above and cathodes below.

SUMMARY

High electrolysis performance can be obtained by efficiently supplying supplied water to an anode gas diffusion layer (oxygen electrode gas diffusion layer) at an anode (oxygen generating electrode) and efficiently extracting and collecting generated hydrogen from a cathode (hydrogen generating electrode). However, at the anode, the generated oxygen may inhibit movement of water, while at the cathode, water accompanying hydrogen ions permeating through the electrolyte membrane (produced water) may inhibit the movement of hydrogen, thereby inhibiting improvement in water electrolysis performance.

The present disclosure suppresses deterioration of water electrolysis performance in a water electrolysis cell, by keeping water from inhibiting movement of generated gas.

One aspect of the present disclosure provides a water electrolysis cell that includes an anode disposed on one side across a solid polymer electrolyte membrane and a cathode disposed on the other side.

The anode is configured of an anode catalyst layer, an anode gas diffusion layer, and an anode separator, laminated in that order from a side of the solid polymer electrolyte membrane.

The cathode is configured of a cathode catalyst layer, a cathode gas diffusion layer, and a cathode separator, laminated in that order from the side of the solid polymer electrolyte membrane.

A first channel is provided in the anode separator, and a wall face of the first channel in the anode separator is imparted with water repellency.

A second channel is provided in the cathode separator, and a wall face of the second channel in the cathode separator is imparted with hydrophilicity.

In the above water electrolysis cell, a portion of the anode gas diffusion layer that faces the channel of the anode separator may be subjected to hydrophilic treatment.

Another aspect of present disclosure provides a water electrolysis stack that includes a plurality of the above-described water electrolysis cells that is stacked. In the water electrolysis stack, the water electrolysis cells are stacked in a vertical direction, disposed with the anodes above and the cathodes below.

According to the present disclosure, gas and water are efficiently separated in the separator, and the movement of generated gas is not readily inhibited by water, thereby enabling suppression of deterioration in water electrolysis performance.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein.

DETAILED DESCRIPTION OF EMBODIMENTS

1. Configuration of Water Electrolysis Cell

Figure 1:
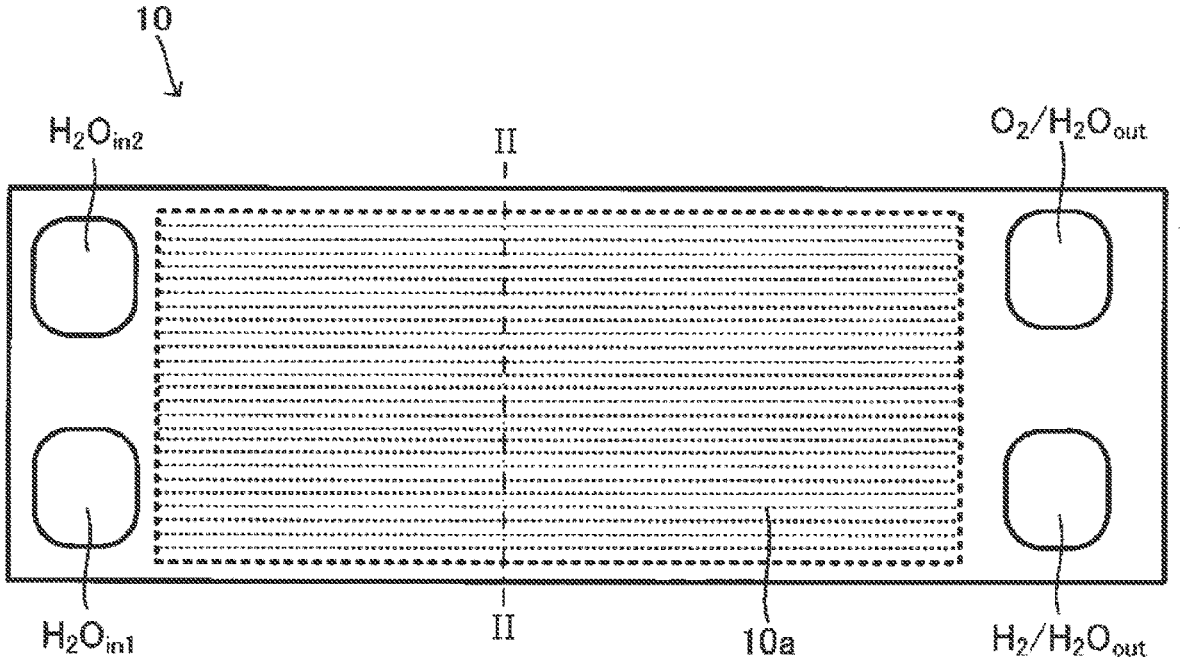
FIG. 1 is a diagram illustrating a water electrolysis cell 10 in plan view.
Figure 2:
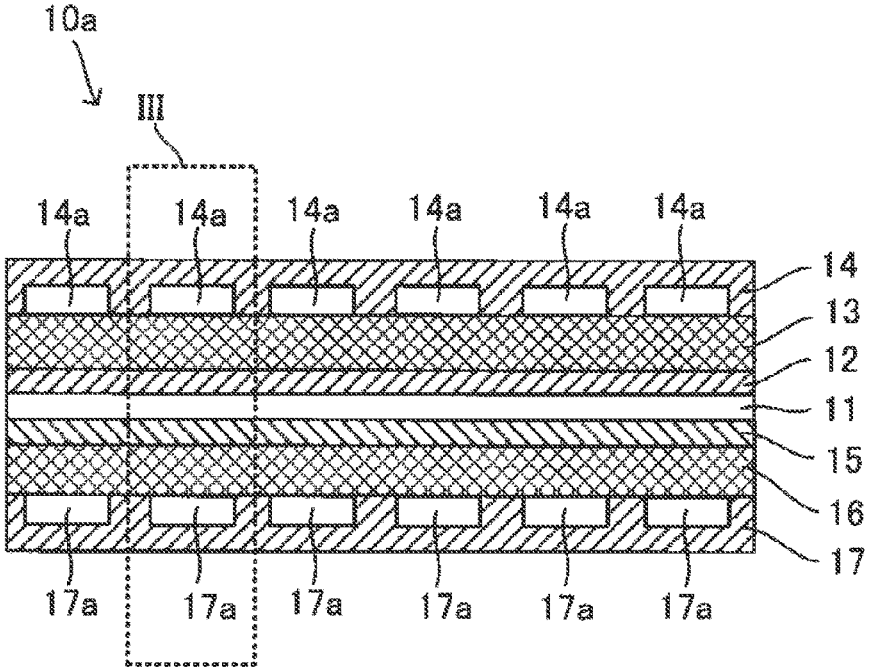
FIG. 2 is a conceptual diagram illustrating a layer structure in a water electrolysis unit 10*a* of the water electrolysis cell 10.
Figure 3:
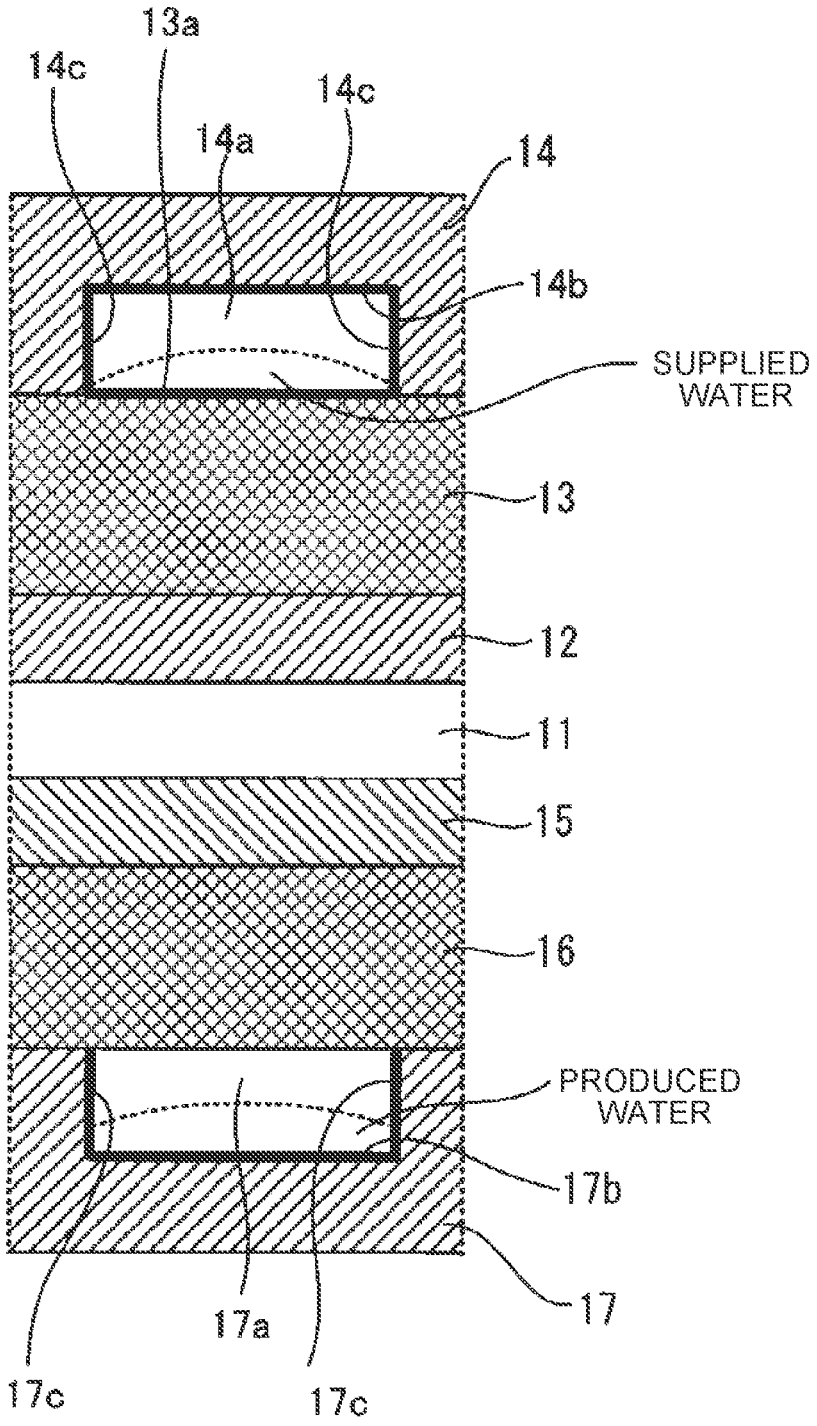
FIG. 3 is an enlarged view of part of FIG. 2.

FIGS. 1 to 3 are diagrams illustrating a water electrolysis cell 10 according to an embodiment. The water electrolysis cell 10 is a unit element for decomposing pure water into hydrogen and oxygen, and a plurality of such water electrolysis cells 10 are stacked to configure a water electrolysis stack. FIG. 1 is a diagram illustrating the water electrolysis cell 10 in plan view, and FIG. 2 is part of a cross-section taken along line II-II in FIG. 1 and is a diagram illustrating a layer structure in a water electrolysis unit 10*a* that is the portion of the water electrolysis cell 10 at which water electrolysis is performed. FIG. 3 is an enlarged view of the portion indicated by III in FIG. 2.

The water electrolysis cell 10 is configured of a plurality of layers, one of which serves as an oxygen generating electrode (anode), and another serves as a hydrogen generating electrode (cathode), with a solid polymer electrolyte membrane 11 interposed therebetween. The anode includes an anode catalyst layer 12, an anode gas diffusion layer 13, and an anode separator 14, laminated in this order from the solid polymer electrolyte membrane 11 side. On the other hand, the cathode includes a cathode catalyst layer 15, a cathode gas diffusion layer 16, and a cathode separator 17, in this order from the solid polymer electrolyte membrane 11 side. Here, a water electrolysis membrane electrode assembly is a laminate of the solid polymer electrolyte membrane 11, the anode catalyst layer 12 disposed on the anode side of the solid polymer electrolyte membrane 11, and the cathode catalyst layer 15 disposed on the cathode side of the solid polymer electrolyte membrane 11. The thickness of the water electrolysis membrane electrode assembly typically is around 0.4 mm, and the thickness of the water electrolysis cell 10 at the water electrolysis unit 10*a* typically is around 1.3 mm.

Each layer is as follows, for example.

1.1. Solid Polymer Electrolyte Membrane

The solid polymer electrolyte membrane 11 is one form of a membrane having proton conductivity. The material (electrolyte) consisting the solid polymer electrolyte membrane 11 in the present embodiment is a solid polymer material, examples of which include an ion exchange membrane that has proton conductivity and is made of a fluororesin, a hydrocarbon resin material, and so forth. This exhibits good proton conductivity (electrical conductivity) under wet conditions. A more specific example is a membrane made of Nafion (registered trademark), which is a perfluoro-based electrolyte. The thickness of the solid polymer electrolyte membrane 11 is not limited in particular, but is no more than 100 μm, preferably no more than 50 μm, and even more preferably no more than 30 μm.

1.2. Anode Catalyst Layer

The anode catalyst layer (oxygen electrode catalyst layer) 12 is a layer having a catalyst containing at least one of noble metal catalysts such as platinum (Pt), ruthenium (Ru), iridium (Ir), and so forth, and oxides thereof. More specifically, examples of the catalyst include platinum, iridium oxides, ruthenium oxides, iridium ruthenium oxides, and mixtures thereof.

Examples of iridium oxides include iridium oxide ($IrO_2$, $IrO_3$), iridium tin oxides, iridium zirconium oxides, and so forth.

Examples of ruthenium oxides include ruthenium oxide ($RuO_2$, $Ru_2O_3$), ruthenium tantalum oxides, ruthenium zirconium oxides, ruthenium titanium oxides, ruthenium titanium cerium oxides, and so forth.

Examples of iridium ruthenium oxides include iridium ruthenium cobalt oxides, iridium ruthenium tin oxides, iridium ruthenium iron oxides, iridium ruthenium nickel oxides, and so forth.

The anode catalyst layer 12 here may contain an ionomer. Containing the ionomer enables coatability to be improved, and further the hydrophilicity of the ionomer can facilitate permeation of water supplied at the time of water decomposition. Examples of the ionomer contained therein include an ionomer containing a perfluoro-based electrolyte that is an electrolyte used in solid polymer electrolyte membranes.

1.3. Anode Gas Diffusion Layer

A known member can be used for the anode gas diffusion layer 13 that is configured of a member having gas permeability and electroconductivity. Specific examples include porous electroconductive members and so forth, made of sintered compacts of metal fibers (e.g., titanium fibers) or metal particles (titanium particles) or the like. Furthermore, a face 13*a* of the anode gas diffusion layer 13 according to the embodiment that faces a channel 14*a* (a first channel) of the anode separator 14 thereof may be subjected to hydrophilic treatment. This facilitates collection of water on a surface of the anode gas diffusion layer 13, and smooth water decomposition can be realized since introduction of water into the anode gas diffusion layer 13 is facilitated by collecting and guiding water. The term "hydrophilic" here means preferably having a contact angle of no more than 50 degrees in a wettability test using deionized water.

Examples of hydrophilic treatment include ultraviolet (UV) light treatment, plasma treatment, and so forth, to impart hydrophilicity to the face 13*a* of the anode gas diffusion layer 13 itself, spraying inorganic compounds such as silica or hydrophilic resin on the face 13*a*, and so forth, thereby forming a hydrophilic layer.

Note however, while a layer of hydrophilic material may be formed as the hydrophilic treatment, this layer should not be formed on a face in contact with the anode separator 14. This is because the presence of hydrophilic material at the interface with the anode separator would form a resistor.

1.4. Anode Separator

The anode separator 14 is a member provided with the channels 14*a* through which pure water is supplied to the anode gas diffusion layer 13, and through which oxygen generated by decomposition of the water flows.

In the present embodiment, inner faces of the channels 14*a* of the anode separator 14 that are bottom faces 14*b* and side faces 14*c* thereof are subjected to water repellency treatment. This enables water to be repelled from the inner faces of the channels 14*a*, and guided to the anode gas diffusion layer 13. The specific form of water-repellency treatment is not limited in particular, but can be performed by forming a water-repellent layer by spraying Teflon (registered trademark) or some other water-repellent material, or the like. In the present embodiment, the bottom faces 14*b* and the side faces 14*c* of the channels 14*a* are imparted with water repellency, but an arrangement may be made in which only the bottom faces 14*b* are imparted with water repellency. The term "water repellency" here means that having a sliding angle of no more than 70 degrees is sufficient, and preferably no more than 10 degrees, in a water repellency test using deionized water.

As can be seen from FIG. 1, the anode separator 14 includes a water inlet port $H_2O_{in1}$ and a water inlet port $H_2O_{in2}$ provided at portions on one end side of the channels 14*a*, and a water and oxygen outlet port $O_2/H_2O_{out}$ and a water and hydrogen outlet port $H_2/H_2O_{out}$ provided at portions on the other end side of the channels 14*a*, at positions on outer sides of the water electrolysis unit 10*a*. The channels 14*a* here communicate with the water inlet port $H_2O_{in1}$ at the one end thereof, and with the water and oxygen outlet port $O_2/H_2O_{out}$ at the other end thereof 1.5. Cathode Catalyst Layer A known catalyst can be used as the catalyst contained in the cathode catalyst layer 15, and examples thereof include platinum, platinum-coated titanium, platinum-on-carbon, palladium-on-carbon, cobalt glyoxime, nickel glyoxime, and so forth. The cathode catalyst layer 15 here may contain an ionomer. Coatability can be improved by containing an ionomer. Examples of the ionomer contained therein include an ionomer made of a perfluoro-based electrolyte that is an electrolyte used in solid polymer electrolyte membranes.

1.6. Cathode Gas Diffusion Layer

A known member can be used for the cathode gas diffusion layer 16 that is configured of a member having gas permeability and electroconductivity. Specific examples include porous members such as carbon cloth, carbon paper, and so forth.

1.7. Cathode Separator

The cathode separator 17 is a member provided with channels 17*a* (a second channel) through which hydrogen generated by reduction of hydrogen ions, and water accompanying hydrogen ions permeating through the solid polymer electrolyte membrane 11 flow.

Inner faces of the channels 17*a* that are bottom faces 17*b* and side faces 17*c*, may be subjected to with hydrophilic treatment. This enables water to be guided to the bottom faces 17*b* of the channels 17*a*, and due to the hydrogen being concentrated on the cathode gas diffusion layer 16 side of the channel 17*a*, outflow of hydrogen gas from the cathode gas diffusion layer 16 to the channel 17*a* can be smoothly carried out. The term "hydrophilic" here means preferably having a contact angle of no more than 50 degrees in a wettability test using deionized water. Although hydrophilic treatment is not limited in particular, the inner faces of the channels 17*a* themselves may be imparted with hydrophilicity, through forming a hydrophilic layer by spraying or the like with silica or some other inorganic compound or hydrophilic resin, UV treatment, or plasma treatment. In the present embodiment, the bottom faces 17*b* and the side faces 17*c* of the channels 17*a* are imparted with hydrophilicity, but an arrangement may be made in which only the bottom faces 17*b* are imparted with hydrophilicity.

As can be seen from FIG. 1, the cathode separator 17 has the water inlet port $H_2O_{in1}$ and the water inlet port $H_2O_{in2}$ provided at portions on one end side of the channels 17*a*, and the water and oxygen outlet port $O_2/H_2O_{out}$ and the water and hydrogen outlet port $H_2/H_2O_{out}$ provided at portions on the other end side of the channels 17*a*, at positions on the outer sides of the water electrolysis unit 10*a*. The channels 17*a* here communicate with the water inlet port $H_2O_{in2}$ at the one end thereof, and with the water and hydrogen outlet port $H_2/H_2O_{out}$ at the other end thereof 1.8. Hydrogen Generation by Water Electrolysis Cell The water electrolysis cell 10 described above generates hydrogen and oxygen from pure water as follows. Accordingly, the water electrolysis cells and the water electrolysis stack according to the present disclosure can include known members and configurations necessary for generating hydrogen, in addition to the above. Pure water ($H_2O$) supplied from the channels 14*a* of the anode separator 14 to the anode (oxygen generating electrode) is decomposed into oxygen, electrons, and protons ($H^+$) in the anode catalyst layer 12 under potential, when current is applied across the anode and the cathode. At this time, the protons travel through the solid polymer electrolyte membrane 11 to the cathode catalyst layer 15. On the other hand, the electrons separated at the anode catalyst layer 12 reach the cathode catalyst layer 15 through an external circuit. The protons then receive the electrons at the cathode catalyst layer 15, thereby generating hydrogen ($H_2$). The generated hydrogen reaches the cathode separator 17 and is discharged through the channels 17*a*. Note that the oxygen generated at the anode catalyst layer 12 reaches the anode separator 14 and is discharged through the channels 14*a*.

2. Water Electrolysis Stack

Figure 4:
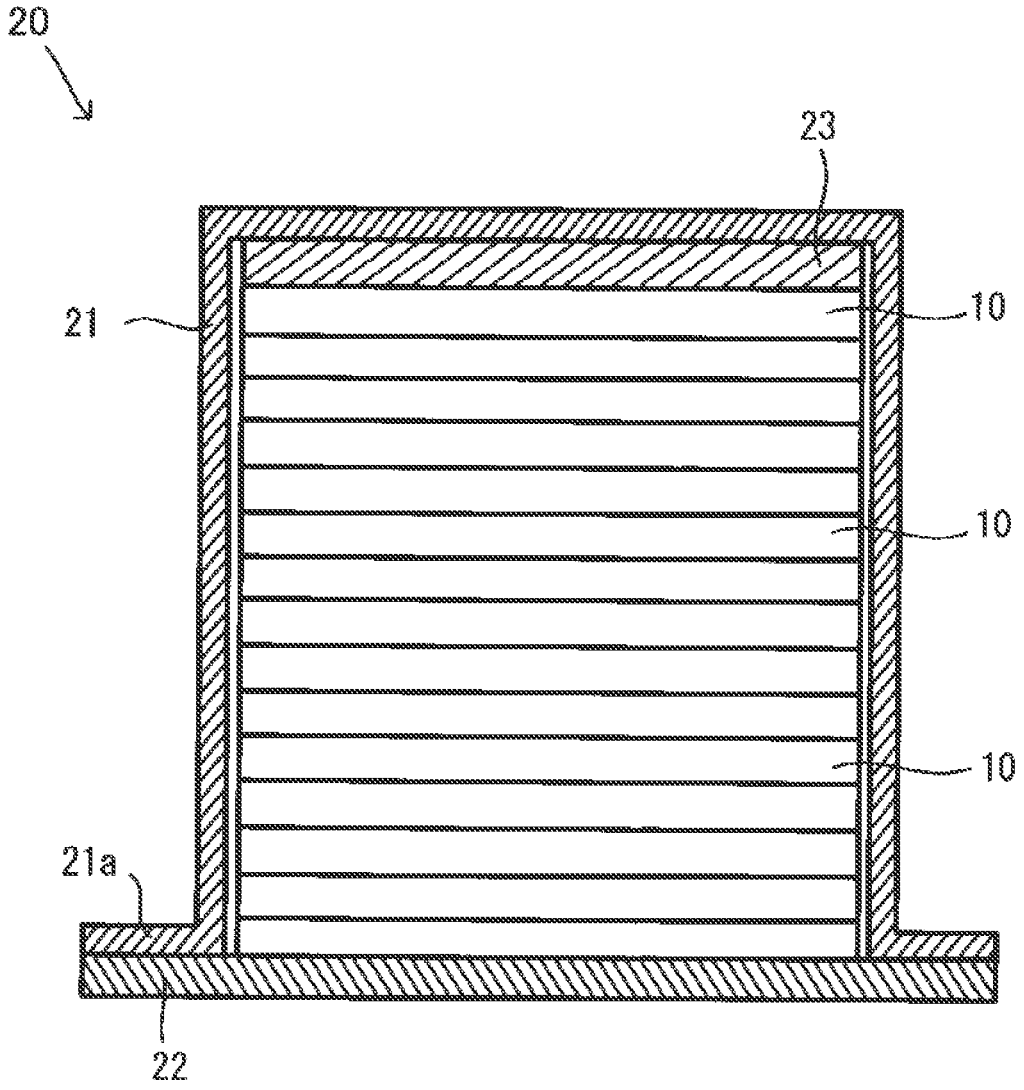
FIG. 4 is a diagram illustrating a structure of a water electrolysis stack 20.

A water electrolysis stack 20 is a member that is configured of a plurality (around 50 to 400) of the above-described water electrolysis cells 10 that are stacked up, and hydrogen and oxygen are generated by conducting electricity to the water electrolysis cells 10. FIG. 4 illustrates an overview of the configuration. The water electrolysis stack 20 includes a stack case 21, an end plate 22, the water electrolysis cells 10, and a biasing member 23.

The stack case 21 is a housing that accommodates the water electrolysis cells 10 that are stacked up, and the biasing member 23 therein. In the present embodiment, the stack case 21 is a square cylinder, open at one end and closed at the other, with a plate-like piece protruding from along edges of an opening thereof, away from the opening, thereby forming a flange 21*a*.

The end plate 22 is a plate-shaped member that closes off the opening of stack case 21. Portions of the end plate 22 that are overlaid by the flange 21*a* of the stack case 21 are fixed to the stack case 21 by bolts, nuts, or the like, so as to cover the stack case 21.

The water electrolysis cells 10 are as described above. Multiple water electrolysis cells 10 as described above are stacked up. Note that in the present embodiment, the water electrolysis cells 10 are configured to be stacked in the vertical direction, and each water electrolysis cell 10 is disposed such that the anode (oxygen generating electrode) is situated on above and the cathode (hydrogen generating electrode) is situated below, as illustrated in FIGS. 2 and 3.

The biasing member 23 fits inside the stack case 21, and exerts a pressing force on the stack of the water electrolysis cells 10 in the direction of stacking thereof. Examples of members that can be used as the biasing member include a disc spring and the like.

3. Effects, etc.

Hydrogen and oxygen are generated by the water electrolysis cell 10 as described above. In the water electrolysis stack 20 in which the anodes are above and the cathodes are below, gravity causes the supplied water to be on the anode gas diffusion layer 13 side and the generated oxygen to be on the opposite side thereof in the channels 14*a* of the anode separator 14, and the produced water is separated from the cathode gas diffusion layer 16 and the hydrogen is in contact with the cathode gas diffusion layer 16 in the channels 17*a* of the cathode separator 17, in a fundamental layout. In reality, however, gas-liquid separation does not always occur in this manner, due to effects of surface tension of the water and so forth, which has inhibited improvement in water electrolysis performance. In contrast, according to the present disclosure, the inner faces (bottom faces 14*b* and side faces 14*c*) of the channels 14*a* of the anode separator 14 have water repellency as illustrated in FIG. 3, making it difficult for water to be retained, and accordingly the supplied water is guided to the anode gas diffusion layer 13 side. Also, the inner faces of the flow channels 17*a* of the cathode separator 17 (bottom faces 17*b* and side faces 17*c*) are hydrophilic and easily attract water, and accordingly separation of produced water from the cathode gas diffusion layer 16, and outflow of hydrogen from the cathode gas diffusion layer 16, are facilitated. Accordingly, water electrolysis is performed smoothly, and thus deterioration of water electrolysis performance can be suppressed.

What is claimed is:

1. A water electrolysis cell comprising an anode disposed on one side across a solid polymer electrolyte membrane and a cathode disposed on the other side, wherein:

the anode is configured of an anode catalyst layer, an anode gas diffusion layer, and an anode separator, laminated in that order from a side of the solid polymer electrolyte membrane;

the cathode is configured of a cathode catalyst layer, a cathode gas diffusion layer, and a cathode separator, laminated in that order from the side of the solid polymer electrolyte membrane;

a first channel through which oxygen generated by decomposition of the water flows is provided in the anode separator, and only a bottom wall face of the first channel in the anode separator is imparted with water repellency; and a second channel through which hydrogen generated by reduction of hydrogen ions flow is provided in the cathode separator, and only a bottom wall face of the second channel in the cathode separator is imparted with hydrophilicity, wherein the anode catalyst layer includes a ionomer to improve coatability and a hydrophilicity of the ionomer facilitates permeation of water supplied at a time of water decomposition.

2. The water electrolysis cell according to claim 1, wherein a portion of the anode gas diffusion layer that faces the first channel of the anode separator is subjected to hydrophilic treatment.

3. A water electrolysis stack comprising a plurality of the water electrolysis cells according to claim 1 that is stacked, wherein the water electrolysis cells are stacked in a vertical direction, disposed with the anodes above and the cathodes below.

4. The water electrolysis cell according to claim 1, wherein imparted with hydrophilicity means having a contact angle of no more than 50 degrees in a wettability test using deionized water.

5. The water electrolysis cell according to claim 1, wherein imparted with water repellency means having a sliding angle of no more than 70 degrees in a water repellency test using deionized water.

6. The water electrolysis cell according to claim 1, wherein imparted with water repellency means having a sliding angle of no more than 10 degrees in a water repellency test using deionized water.

* * * * *